United States Patent [19]

Gefvert

[11] Patent Number: 4,888,804

[45] Date of Patent: Dec. 19, 1989

[54] SOUND REPRODUCTION SYSTEM

[76] Inventor: Herbert I. Gefvert, 495 S. Green Bay Rd., Lake Forest, Ill. 60045

[21] Appl. No.: 193,900

[22] Filed: May 12, 1988

[51] Int. Cl.[4] ..... H04R 5/02

[52] U.S. Cl. ..... 381/24; 381/90; 381/205

[58] Field of Search ..... 381/24, 1, 27, 88, 89, 381/90, 188, 205

[56] References Cited

U.S. PATENT DOCUMENTS

| | | | |
|---|---|---|---|
| 4,199,658 | 4/1980 | Iwahara . | |
| 4,249,037 | 2/1981 | Dexter | 381/24 |
| 4,256,922 | 3/1981 | Görike | 381/24 |
| 4,266,092 | 5/1981 | Barker, III | 381/24 |
| 4,489,432 | 12/1984 | Polk | 381/24 |
| 4,497,064 | 1/1985 | Polk | 381/24 |
| 4,503,553 | 3/1985 | Davis | 381/24 |
| 4,569,074 | 2/1986 | Polk | 381/24 |
| 4,586,192 | 4/1986 | Arntson | 381/24 |
| 4,596,034 | 6/1986 | Moncrieff | 381/89 |

*Primary Examiner*—Forester W. Isen

*Attorney, Agent, or Firm*—Neuman, Williams, Anderson & Olson

[57] ABSTRACT

A sound reproduction system for providing an enhanced stereophonic image within an enlarged listening area includes both a left and a right transducer enclosure, each enclosure having a main transducer array for receiving an audio channel signal and providing direct reproduction thereof, the main transducer array being directed into a listening area and having a dispersion profile which substantially defines the listening area, a boundary transducer for reproducing a frequency band-limited and 180 degree phase-shifted audio channel signal, the boundary transducer being directed at an angle of substantially 65 degrees with respect to the main transducer array, and an expansion transducer for reproducing a frequency band-limited audio channel signal, the expansion transducer being directed outwardly from the listening area, with the enclosure being adapted to provide structural support for the main transducer array, the boundary transducer and the expansion transducer and to maintain a predetermined angular relationship therebetween.

19 Claims, 3 Drawing Sheets

SOUND REPRODUCTION SYSTEM

BACKGROUND OF THE INVENTION

The present invention relates generally to sound reproduction systems, and more particularly to multiple channel sound reproduction systems. Specifically, the present invention provides an improved stereophonic sound reproduction system that generates for listeners an improved stereophonic image within a large listening area.

A perennial problem in the design of loudspeaker systems for stereophonic sound reproduction has been the general inability to provide coherent stereo imaging within a large listening area. Numerous techniques have been developed for enhancing the image, but the use of such techniques has invariably resulted in a reduced listening area size. The trade-off has been that the sharper stereo image gained by the use of these techniques has been at the expense of having to settle for a narrower stereo listening area. Such techniques are numerous and generally include the need to make geometric assumptions which only hold true within a very narrow listening area. For example, multiple driver arrays have been configured so that the voice coils of each driver are vertically coplanar on a plane perpendicular to the listener. This effectively reduces phase shifting across the frequency spectrum since each voice coil of the array is equidistant from the listener. Unfortunately, this enhanced phase alignment is geometrically dependent upon the location of the listener, and, in a two-speaker system, can occur ideally at only one point in space.

Another technique by which stereo imaging has been enhanced has been the cancellation of interaural crosstalk. Interaural crosstalk occurs when, for example, left channel sound enters the listener's right ear and vice versa. This results in false imaging and an unnatural sense to the listener which would not be present at a live performance. Interaural crosstalk has been cancelled by inverting and delaying each signal channel and adding it to the other signal channel. The amount of delay is critical and depends, among other things, on the location of the listener with respect to the loudspeakers and the width of his head from ear to ear. Again, critical geometrical relationships are necessary for the listener to perceive the enhanced image. This results in a very small listening area.

SUMMARY OF THE INVENTION

It is a principal object of the present invention to provide a stereophonic sound reproduction system that generally overcomes the deficiencies of the prior art.

It is a more specific object of the present invention to provide a sound reproduction system that provides an enhanced stereophonic image within a large listening area.

The above and other objects are accomplished by a sound reproduction system having both a left and a right transducer enclosure, each enclosure having a main transducer array for receiving an audio channel signal and providing direct reproduction thereof, the main transducer array being directed into a listening area and having a dispersion profile which substantially defines the listening area, a boundary transducer for reproducing a frequency band-limited and 180 degree phase-shifted audio channel signal, the boundary transducer being directed at an angle of about 65 degrees with respect to the main transducer array, and an expansion transducer for reproducing a frequency band-limited audio channel signal, the expansion transducer being directed outwardly from the listening area, with the enclosure being adapted to provide structural support for the main transducer array, the boundary transducer and the expansion transducer and to maintain a predetermined angular relationship therebetween.

The main transducer array is made of a number of drivers and is capable of reproducing the entire human-audible frequency band. The drivers of the main array are further mounted on a panel which forms one side of a multi-sided speaker enclosure. The main array panels of the left and right speaker enclosures are canted toward each other and into the listening area generally therebetween. The boundary transducer of each loudspeaker receives and reproduces a frequency band-limited component of that speaker's audio channel signal and is further connected 180 degrees out of phase with respect to the main array. Finally, the expansion transducer of each loudspeaker receives and reproduces a frequency band-limited component of that speaker's audio channel signal, connected in phase with respect to the main array.

In addition to the front loudspeakers, the system of the present invention may be provided with either a front center transducer, a rear transducer or transducers, or both. A center front transducer which would receive and reproduce a frequency band-limited summation of the left and right audio channel signals could be used if the left and right front loudspeakers are positioned sufficiently far apart from each other. A center rear transducer or left and right rear transducers, which would receive and reproduce a frequency band-limited subtraction of the left audio channel signal from the right, may further be used.

The appended claims set forth the features of the present invention with particularity. The invention, together with its objects and advantages, may be best understood from the following detailed description taken in conjunction with the accompanying drawings of which:

DETAILED DESCRIPTION OF THE PREFERRED EMBODIMENT

The present invention sets forth the architecture of an improved sound reproduction system. A listener's experience of a stereophonic image is expanded from a conventional flat frontal panorama to a three dimensional sensation within a large listening area.

Figure 1:
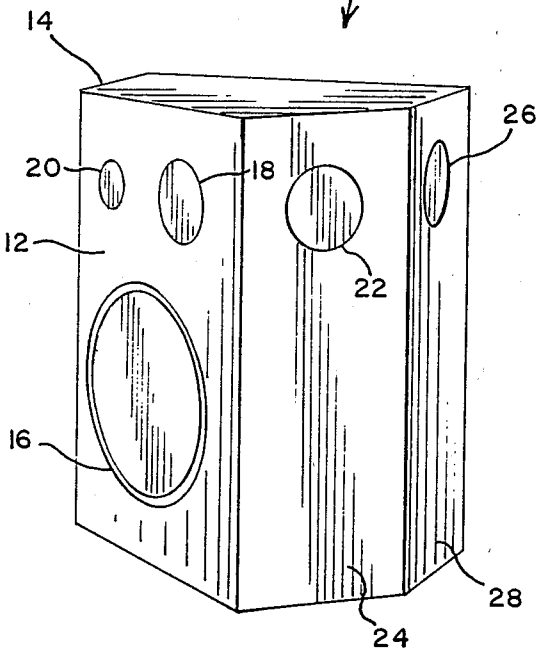
FIG. 1 is perspective view of a front loudspeaker of the sound reproduction system of the present invention.

Turning now to the drawings, FIG. 1 illustrates a loudspeaker 10 of the system of the present invention. Loudspeaker 10 has a main acoustic transducer array, symbolically represented at 11 in FIG. 2, mounted on a panel 12 comprising one side of a multi-sided enclosure 14 of loudspeaker 10. The main array is adapted to receive and reproduce the entire human-audible frequency band of an audio channel signal and, preferably, consists of three separate drivers, a low frequency driver 16, a middle frequency driver 18 and a high frequency driver 20. The drivers 16, 18, 20 each receive and reproduce a different component of the frequency band of an audio channel signal. The frequency band component received by each driver is determined and provided for by a conventional crossover network.

Figure 2:
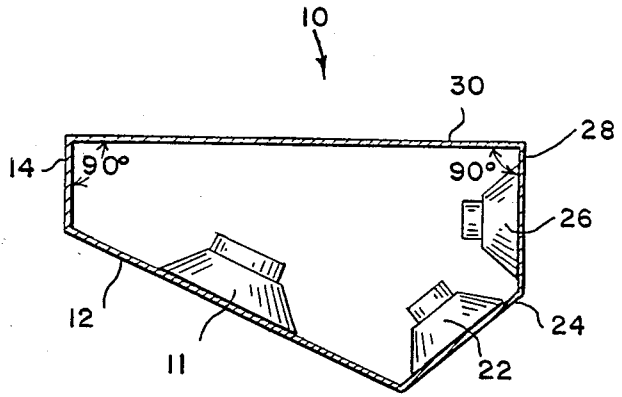
FIG. 2 is a plan view of the loudspeaker of FIG. 1.

Loudspeaker 10 further has a boundary transducer 22 mounted on a panel 24 of enclosure 14. As can be seen in FIG. 2, panel 24 is normally at an angle of about 65 degrees with respect to panel 12. This angular relationship, about 65 degrees in the preferred embodiment, is not critical and need only be of a magnitude great enough such that the dispersion profile of boundary transducer 22 does not directly intersect that of the main array 11. Boundary transducer 22 receives and reproduces the same audio channel signal as does the main array 11, but limited to the frequency band of up to 4,000 Hertz, and in a manner that is 180 degrees out of phase with respect to main array 11. An expansion transducer 26 is mounted on a panel 28 of enclosure 14. As can be seen in FIG. 2, panel 28 is perpendicular to a back panel 30 of enclosure 14. Expansion transducer 26 receives and reproduces the same audio channel signal as does the main array 11, but limited to the frequency band of 400 to 20,000 Hertz.

Figure 3:
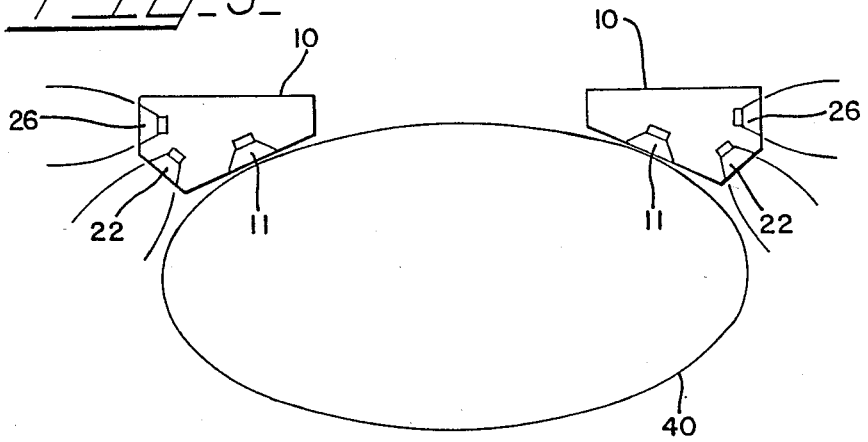
FIG. 3 is a plan view of the system of the present invention configured with left and right front loudspeakers.

Referring to FIG. 3, a pair of symmetrical loudspeakers 10 cooperate in the sound reproduction system of the present invention. A large listening area 40 is provided, substantially defined by the dispersion profiles of the main transducer arrays 11 of the loudspeakers 10. By virtue of the shape of the loudspeakers 10, the main transducer arrays 11 are canted inward to be directed into the listening area 40. Canting the main array 11 in this manner improves phase alignment between the drivers 16, 18, 20 of the main array 11, thereby reducing transient distortion and improving clarity of sound. Loudspeakers 10 are preferably positioned adjacent to or mounted to a wall such that the expansion transducer 26 of each loudspeaker 10 is directed perpendicularly with respect to the wall.

It has been found that reflected tones and interaural crosstalk can severely deteriorate the stereophonic image in the broad frequency band from approximately 20 to 4,000 Hertz. Reflected tones are caused by non-linear room boundaries, and interaural crosstalk arises when left channel tones enter the listener's right ear and vice versa. Such reflected tones and interaural crosstalk are cancelled by the boundary transducer which is positioned at the outer perimeter of the listening area 40 and is electrically connected 180 degrees out of phase with respect to the main array 11. The 180 degree phase shift can be accomplished by simply reversing the leads on the voice coil of boundary transducer 22 with respect to the orientation of the leads on the voice coil of the main array 11, or it can be accomplished by inverting the signal with an active crossover network. Inasmuch as reflected tones and interaural crosstalk negatively affect the stereophonic image most at frequencies up to about 4,000 Hertz, the signal reproduced by the boundary transducer 22 is frequency band-limited to substantially attenuate components of the signal above 4,000 Hertz.

The boundary transducers 22 effectively cancel first arrival reflections from room boundaries which would otherwise smear the sonic image, leaving only crisp, vivid in-phase tones within the listening area 40. The boundary transducers 22 also, however, effectively cancel the late arrival reverberations which give the desirable perception of spaciousness to the listener. To restore this perception of spaciousness, the expansion transducer 26 is provided in each loudspeaker 10, directed outwardly from the listening area 40 and frequency band-limited to receive and reproduce those components of each audio channel signal between about 400 to 20,000 Hertz. Although frequency components above about 8,000 Hertz do affect the listener's perception of spaciousness, because of the outward orientation of expansion transducer 26, shorter wavelength tones corresponding to frequencies above about 8000 Hertz do not interfere with the image perceived by the listener created by the main array 11. This is so because shorter wavelength tones from expansion transducer 26 are reflected before entering the listening area 40 and are thus substantially attenuated and greatly out of phase with respect to the sound from main array 11. As a result of the configuration of the loudspeakers 10 as described above, a listener within the listening area 40 experiences a mosaic of dominant direct vivid in-phase tones with an overlay of diminished intensity phase altered late arrival reverberant signals.

The sound reproduction system described above in conjunction with FIG. 3 provides an improved stereophonic image for a listener within a large listening area. The size of the listening area 40 is variable by varying the spacing of the loudspeakers 10 from each other. In general, satisfactory imaging is possible with a spacing between loudspeakers 10 of between about 6 and 48 feet. This will generate a listening area 40 having a width dimension of about the same as the loudspeaker spacing and a depth dimension of about half the width dimension, as can be seen in FIG. 3. It should be noted that the maximum spacing between loudspeakers 10 while maintaining satisfactory imaging may be less than 48 feet if the noise level of the listening environment is high or if the listening area 40 is within a room having unusual acoustic absorption characteristics.

Figure 4:
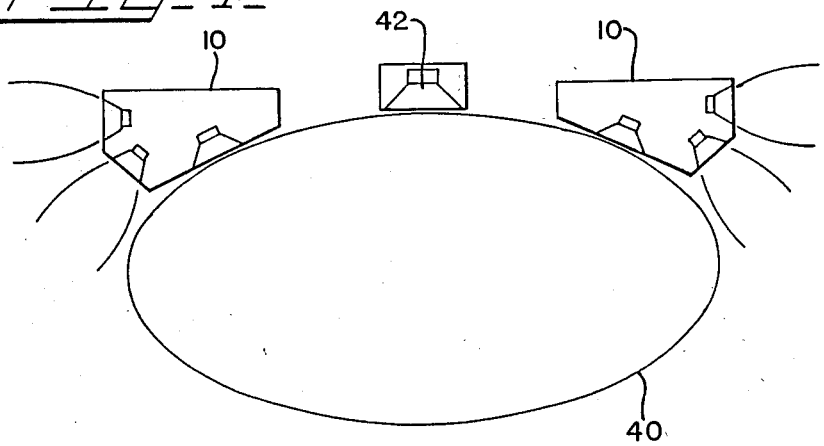
FIG. 4 is a plan view similar to FIG. 3, but further showing a center front transducer.

With a loudspeaker spacing of more than about 48 feet, a noticeable sonic void appears in the center of the listening area. To overcome this void, a center transducer loudspeaker 42 is placed at front center, intermediate the loudspeakers 10, in a second embodiment of the sound reproduction system of the present invention as shown in FIG. 4. Center transducer 42 is disposed to reproduce a summation of the left and right audio channel signals and, preferably, comprises a dual voice coil driver for carrying out the summation. Inasmuch as a dual voice coil driver receiving both the left and right audio channel signals would otherwise receive total audio power equal to the summation of the audio power of the left and right audio channel signals, an in-line power resistor (not shown) is provided so that the audio power received by the center transducer 42 is approximately equal to the left or right audio channel signal. Thus, what the listener experiences from the center transducer 42 is a monophonic signal which equals the left plus the right audio channel signals. The frequency response of the center transducer 42 is band-limited so that frequency components of the summation signal above about 1,200 Hertz are substantially attenuated. This frequency contouring is necessary so that the frequency components of the sound reproduced by the center transducer 42 are below the human pinar localizing frequency. The pinar localizing frequency is the frequency above which human listeners can discriminate and localize a sonic source. It is important that the center transducer 42 not reproduce sounds above the pinar localizing frequency, since such sounds could destabilize the stereo image created by the left and right front loudspeakers 10. Placing the center transducer 42 centrally between the left and right front loudspeakers 10 and sharply rolling off the frequency response above about 1,200 Hertz fills the sonic void in the center of the listening area 40 without altering the image produced therein or the listener's ability to localize the source of sound.

The sound reproduction system of the present invention is dependent upon tones reflected from behind the listening area 40 to complete the stereo imaging. If the shape of the room is too deep or too wide, or the level of the background noise is too high, or the sound absorption of the back walls or ceiling is too great, the enhanced imaging can be adversely affected. To compensate for these problems, a rear transducer that projects into the listening area 40 from behind is provided in yet another embodiment of the present invention. Such a rear transducer is shown at 44 in FIG. 6 and is disposed to reproduce a signal representing the subtraction of the left audio channel signal from the right audio channel signal. Preferably, the subtraction is carried out by a dual voice coil driver in a manner similar to the manner in which the summation of the left and right audio channels is carried out in the front center transducer 42.

Figure 5:
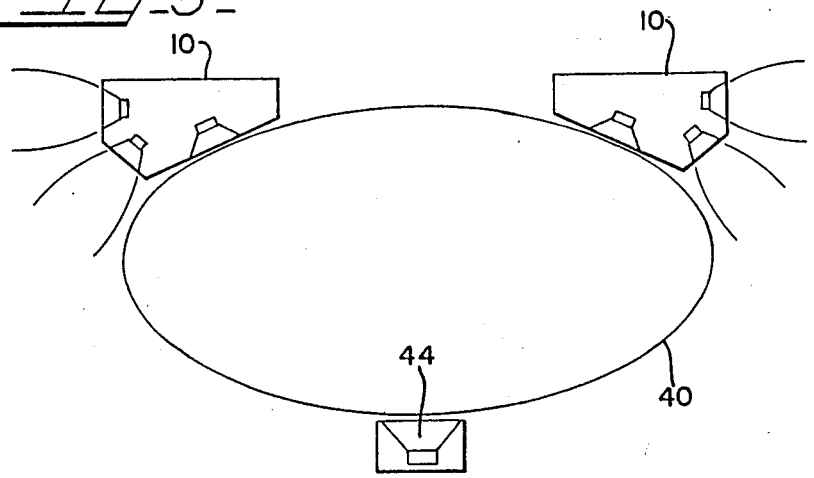
FIG. 5 is a plan view similar to FIG. 3, but further showing a center rear transducer.
Figure 6:
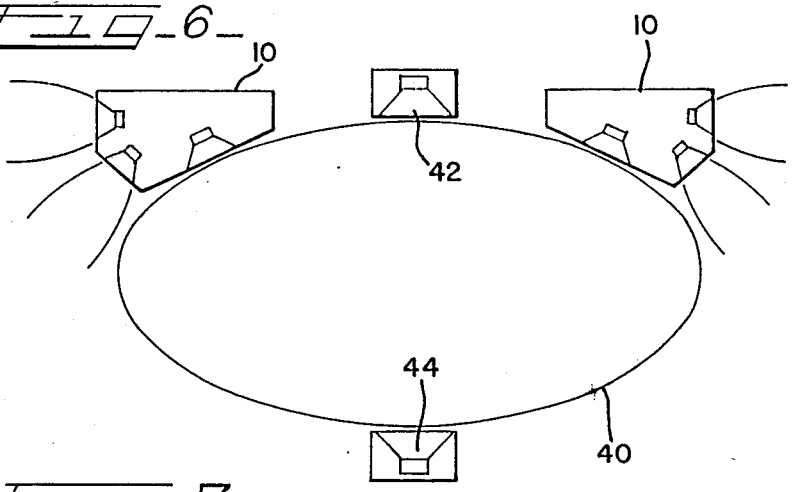
FIG. 6 is a plan view similar to FIG. 4, but further showing a center rear transducer.

A signal representing the difference between the right and left audio channel signals is reproduced by the rear transducer 44 so that the acoustic output of the rear transducer 44 is large when there is a great difference between the left and right audio signals and is zero when the left and right signals are the same. This is done primarily to preserve imaging when a vocal soloist is present in the sound to be reproduced. Vocal soloists are recorded virtually monophonically, and that signal is split equally between the left and right stereo audio channel signals. With the rear transducer 44 of the present invention, reproducing only a difference signal, a vocal soloist's signal will be completely absent from the rear, as it should be to create a listener's perception that a vocalist is located centrally in front of the listening area. Although the difference signal of the rear transducer 44 preserves a frontal orientation sensation of a vocal soloist, a difference between left and right which would arise from the recording of an orchestra or a chorus is still available to simulate reflected tones from the rear, enhancing the image produced by the present sound reproduction system. Again, to ensure stereo imaging within the listening area 40, the rear transducer 44 is frequency band-limited to substantially attenuate components of the subtraction signal above the pinar localizing frequency of about 1,200 Hertz. Sharp roll-off above 1,200 Hertz avoids splitting the stereo image which takes place in the front. It should be understood that the rear transducer 44 may be used either with a front center transducer 42, as shown in FIG. 6, or without a front center transducer 42, as shown in FIG. 5, depending upon the needs of any particular application.

Figure 7:
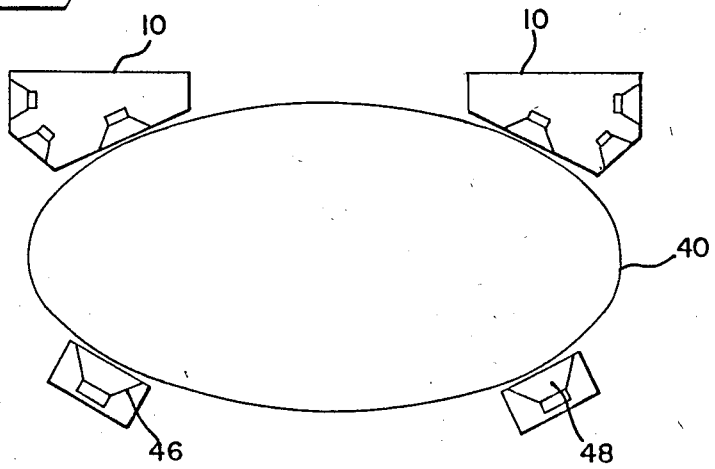
FIG. 7 is a plan view similar to FIG. 3, but further showing left and right rear transducers.
Figure 8:
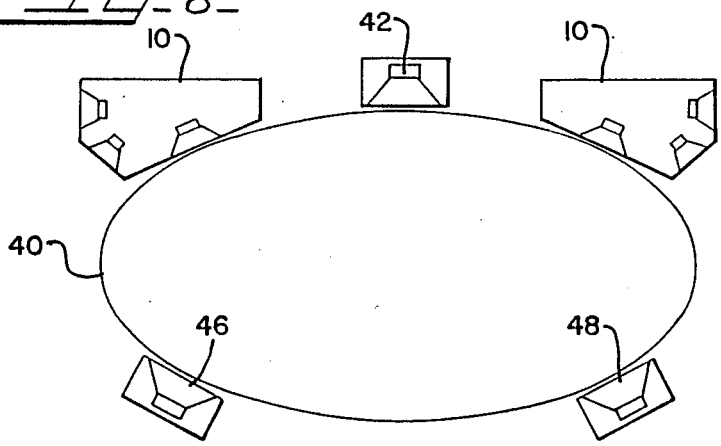
FIG. 8 is a plan view similar to FIG. 7, but further showing a center front transducer.

In place of the single rear transducer 44, a further embodiment of the present invention is described with reference to FIG. 7, having a left rear transducer 46 and a right rear transducer 48. Both the left rear transducer 46 and the right rear transducer 48 are, like the single rear transducer 44, frequency band-limited to substantially attenuate components of their respective signals above about 1,200 Hertz. The left rear transducer 46 and the right rear transducer 48 both reproduce a signal representing the subtraction of the left audio channel signal from the right, similar to the center rear transducer 44 described above. Prior to the subtraction, the left audio channel signal component of the left rear transducer's subtraction signal is attenuated, and the right audio channel signal component of the right rear transducer's subtraction signal is similarly attenuated. The magnitude of these attenuations is preferably about 8 decibels in order to avoid transients which would become additive between the left front and left rear transducers, or right front and right rear transducers, causing multiple acoustic centers. In addition, this would allow for a maximum variation in intensity between left and right signals of 16 decibels. Such a 16 decibel variation is the maximum variation which would not cause a shift in image. Furthermore, attenuating the signal components of each rear transducer as described above causes a crossfiring of the rear transducers which further centralizes the stereo image. As with the single rear transducer 44, dual rear transducers can be used either with a front center transducer 42, as shown in FIG. 8, or without, as shown in FIG. 7.

It will be appreciated by those skilled in the art that modifications to the foregoing preferred embodiment may be made in various aspects. The present invention is set forth with particularity in the appended claims. It is deemed that the spirit and scope of that invention encompasses such modifications and alterations to the preferred embodiment as would be apparent to one of ordinary skill in the art and familiar with the teachings of the present application.

I claim:

1. A sound reproduction system for providing a sonic image within a defined listening area in response to a plurality of audio channel signals, said system comprising a plurality of transducer enclosure means, each of said enclosure means having:

main transducer means for receiving one of said audio channel signals and providing direct reproduction of essentially the entire frequency band thereof, said main transducer means being directed into the listening area and having a dispersion profile which substantially defines the listening area;

boundary transducer means for receiving said one audio channel signal, said boundary transducer means having means for phase-shifting said one audio channel signal by 180 degrees and means for limiting the bandwidth of said one audio signal to a first predetermined range, whereby said boundary transducer means provides reproduction of a frequency band-limited and 180 degree phase-shifted audio channel signal, said boundary transducer means being directed at an angle of substantially 65 degrees with respect to said main transducer means; and expansion transducer means for receiving said one audio channel signal, said expansion transducer means having means for limiting the bandwidth of said one audio channel signal to a second predetermined range, whereby said expansion transducer means provides reproduction of a frequency band-limited audio channel signal, said expansion transducer means being directed outwardly from the listening area;

said enclosure means being adapted to provide structural support for said main, boundary and expansion transducer means and to maintain a predetermined angular relationship therebetween.

2. A sound reproduction system as recited in claim 1, wherein said main transducer means comprises a low frequency driver for reproducing low frequency components of an audio channel signal, a middle frequency driver for reproducing middle frequency components of an audio channel signal and a high frequency driver for reproducing high frequency components of an audio channel signal, whereby substantially the entire human-audible frequency band of an audio channel signal is reproduced by said main transducer means.

3. A sound reproduction system as recited in claim 1, wherein said first predetermined range is substantially from 0 to 4000 Hertz, whereby said boundary transducer means is frequency band-limited to substantially attenuate components of said 180 degree phase-shifted audio channel signal above 4000 Hertz.

4. A sound reproduction system as recited in claim 1, wherein said second predetermined range is substantially from 400 to 20,000 Hertz, whereby said expansion transducer means is frequency band-limited to substantially reproduce components of said audio channel signal between 400 and 20,000 Hertz.

5. A sound reproduction system as recited in claim 1 comprising left transducer enclosure means for reproducing a left audio channel signal, and right transducer enclosure means for reproducing a right audio channel signal, said left and right transducer enclosure means being disposed in a spaced-apart relationship in front of the listening area.

6. A sound reproduction system as recited in claim 5, further comprising center transducer means having means for summing said left and right audio channel signals and means for limiting the bandwidth of said summation to a third predetermined range, whereby said center transducer means reproduces a frequency band-limited summation of said left and right audio channel signals, said center transducer means being disposed intermediate said left and right enclosure means and directed into the listening area.

7. A sound reproduction system as recited in claim 6, wherein said summing means comprises a dual voice coil driver.

8. A sound reproduction system as recited in claim 6, wherein said third predetermined range is substantially from 0 to 1200 Hertz, whereby said center transducer means is frequency band-limited to substantially attenuate frequency components of said summation of said left and right audio channel signals above 1200 Hertz.

9. A sound reproduction system as recited in claim 5, further comprising rear transducer means having means for subtracting said left audio channel signal from said right audio channel signal and means for limiting the bandwidth of said subtraction to a fourth predetermined range, whereby said rear transducer means reproduces a frequency band-limited subtraction of said left audio channel signal from said right audio channel signal, said rear transducer means being disposed behind the listening area and directed into the listening area.

10. A sound reproduction system as recited in claim 9, wherein said subtracting means comprises a dual voice coil driver.

11. A sound reproduction system as recited in claim 9, wherein said fourth predetermined range is substantially from 0 to 1200 Hertz, whereby said rear transducer means is frequency band-limited to substantially attenuate frequency components of said subtraction above 1200 Hertz.

12. A sound reproduction system as recited in claim 11, further comprising center transducer means having means for summing said left and right audio channel signals and means for limiting the bandwidth of said summation to a range of substantially from 0 to 1200 Hertz, whereby said center transducer means reproduces a frequency band-limited summation of said left and right audio channel signals, said center transducer means being disposed intermediate said left and right transducer enclosure means and directed into the listening area.

13. A sound reproduction system as recited in claim 5, further comprising left rear transducer means having means for attenuating said left audio channel signal and means for subtracting said attenuated left audio channel signal from said right audio channel signal and means for limiting the bandwidth of said subtraction to a fifth predetermined range, whereby said left rear transducer means reproduces a frequency band-limited subtraction of said attenuated left audio channel signal from said right audio channel signal, and right rear transducer means having means for attenuating said right audio channel signal and means for subtracting said left audio channel signal from said attenuated right audio channel signal and means for limiting the bandwidth of said subtraction to a sixth predetermined range, whereby said right rear transducer means reproduces a frequency band-limited subtraction of said left audio channel signal from said attenuated right audio channel signal, said left rear and right rear transducer means being disposed behind the listening area and directed into the listening area.

14. A sound reproduction system as recited in claim 13, wherein said subtracting means of each of said left rear and right rear transducer means comprises a dual voice coil driver.

15. A sound reproduction system as recited in claim 13, wherein said fifth and sixth predetermined ranges are each substantially from 0 to 1200 Hertz, whereby said left rear and right rear transducer means are frequency band-limited to substantially attenuate frequency components of said subtractions above 1200 Hertz.

16. A sound reproduction system as recited in claim 15, further comprising center transducer means having means for summing said left and right audio channel signals and means for limiting the bandwidth of said summation to a range of substantially from 0 to 1200 Hertz, whereby said center transducer means reproduces a frequency band-limited summation of said left and right audio channel signals, said center transducer means being disposed intermediate said left and right transducer enclosure means and directed into the listening area.

17. A sound reproduction system as recited in claim 13, wherein said attenuating means of each of said left rear and right rear transducer means attenuates said left and right audio channel signals, respectively, by 8 decibels.

18. A sound reproduction system for providing a sonic image within a defined listening area in response to a plurality of audio channel signals, said system comprising a plurality of transducer enclosure means, each of said enclosure means having:

main transducer means for receiving one of said audio channel signals and providing direct reproduction thereof, said main transducer means being directed into the listening area and having a dispersion profile which substantially defines the listening area;

boundary transducer means for receiving said one audio channel signal, said boundary transducer means having means for phase-shifting said one audio channel signal by 180 degrees and means for limiting the bandwidth of said signal to a range of substantially from 0 to 4000 Hertz, whereby said boundary transducer means provides reproduction of a frequency band-limited and 180 degree phase-shifted audio channel signal, said boundary transducer means being directed at an angle of substantially 65 degrees with respect to said main transducer means; and expansion transducer means for receiving said one audio channel signal, said expansion transducer means having means for limiting the bandwidth of said one audio channel signal to a range of substantially from 400 to 20,000 Hertz, whereby said expansion transducer means provides reproduction of a frequency band-limited audio channel signal, said expansion transducer means being directed outwardly from the listening area; said enclosure means being adapted to provide structural support for said main, boundary and expansion transducer means and to maintain a predetermined angular relationship therebetween.

19. A sound reproduction system for providing a stereophonic image within a defined listening area in response to left and right audio channel signals, said system comprising left and right transducer enclosure means for reproducing the left and right audio channel signals respectively, said left and right enclosure means being disposed in a spaced-apart relationship in front of the listening area and adjacent to a wall, each of said enclosure means having:

main transducer means for receiving one of said audio channel signals and providing direct reproduction thereof, said main transducer means being directed into the listening area and having a dispersion profile which substantially defines the listening area;

boundary transducer means for receiving said one audio channel signal, said boundary transducer means having means for phase-shifting said one audio channel signal by 180 degrees and means for limiting the bandwidth of said signal to a range of substantially from 0 to 4000 Hertz, whereby said boundary transducer means provides reproduction of a frequency band-limited and 180 degree phase-shifted audio channel signal, said boundary transducer means being directed at an angle of substantially 65 degrees with respect to said main transducer means; and expansion transducer means for receiving said one audio channel signal, said expansion transducer means having means for limiting the bandwidth of said one audio channel signal to a range of substantially from 400 to 20,000 Hertz, whereby said expansion transducer means provides reproduction of a frequency band-limited audio channel signal, said expansion transducer means being directed outwardly from the listening area and perpendicularly with respect to the wall;

said enclosure means being adapted to provide structural support for said main, boundary and expansion transducer means and to maintain a predetermined angular relationship therebetween.

* * * * *